US007540326B2

(12) United States Patent
Rytlewski

(10) Patent No.: US 7,540,326 B2
(45) Date of Patent: Jun. 2, 2009

(54) SYSTEM AND METHOD FOR WELL TREATMENT AND PERFORATING OPERATIONS

(75) Inventor: Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 380 days.

(21) Appl. No.: 11/308,502

(22) Filed: Mar. 30, 2006

(65) Prior Publication Data

US 2007/0227735 A1 Oct. 4, 2007

(51) Int. Cl.
*E21B 29/00* (2006.01)
*E21B 29/02* (2006.01)

(52) U.S. Cl. ..... 166/297; 166/291; 166/177.4

(58) Field of Classification Search ..... 166/297, 166/291, 55.1, 177.4, 305.1
See application file for complete search history.

(56) References Cited

U.S. PATENT DOCUMENTS 3,542,130 A 11/1970 Stout
3,601,196 A * 8/1971 Childers et al. ..... 166/297
4,850,438 A * 7/1989 Regalbuto ..... 175/4.56
4,991,653 A 2/1991 Schwegman
5,029,644 A 7/1991 Szarka et al.
5,361,856 A 11/1994 Surjaatmadja et al.
5,765,642 A 6/1998 Surjaatmadja
5,775,426 A * 7/1998 Snider et al. ..... 166/308.1
5,890,537 A 4/1999 Lavaure et al.
5,967,231 A * 10/1999 Laurel et al. ..... 166/250.04
6,286,599 B1 9/2001 Surjaatmadja et al.
6,333,699 B1 12/2001 Zierolf
6,336,506 B2 * 1/2002 Wesson ..... 166/308.1
6,386,288 B1 5/2002 Snider et al.
6,464,008 B1 10/2002 Roddy et al.
6,474,421 B1 11/2002 Stoesz
6,520,258 B1 * 2/2003 Yang et al. ..... 166/297
6,536,524 B1 3/2003 Snider
6,568,474 B2 * 5/2003 George et al. ..... 166/278
6,662,874 B2 12/2003 Surjaatmadja et al.
6,719,054 B2 4/2004 Cheng et al.
6,723,933 B2 4/2004 Haag et al.

(Continued)

FOREIGN PATENT DOCUMENTS

WO 2005090742 A1 9/2005

OTHER PUBLICATIONS

Thomson and Nazroo, "Design and Installation of a Cost-Effective Completion System for Horizontal Chalk Wells Where Multiple Zones Require Acid Stimulation", SPE Drilling & Completion, Sep. 1998, pp. 151-156.

*Primary Examiner*—Jennifer H Gay
*Assistant Examiner*—Cathleen R Hutchins
(74) *Attorney, Agent, or Firm*—Jeremy P. Welch; James L. Kurka; Van Someren, PC

(57) ABSTRACT

A technique is provided to facilitate perforation operations in a well. A well treatment operation is combined with a perforating operation to increase the efficiency of well preparation. A dart assembly has a dart for moving a well treatment fluid downhole and a perforating gun coupled to the dart. As the dart moves the well treatment fluid to a desired region of the well, the perforating gun is simultaneously moved to a desired location for perforation of the well.

23 Claims, 4 Drawing Sheets

U.S. PATENT DOCUMENTS

| | | | | |
|---|---|---|---|---|
| 6,759,968 | B2 | 7/2004 | Zierolf | |
| 6,761,219 | B2 | 7/2004 | Snider et al. | |
| 6,907,936 | B2 | 6/2005 | Fehr et al. | |
| 2002/0007949 | A1 | 1/2002 | Tolman et al. | |
| 2002/0093431 | A1 | 7/2002 | Zierolf | |
| 2002/0158120 | A1 | 10/2002 | Zierolf | |
| 2003/0090390 | A1* | 5/2003 | Snider et al. | 340/853.3 |
| 2004/0040707 | A1 | 3/2004 | Dusterhoft et al. | |
| 2004/0118564 | A1 | 6/2004 | Themig et al. | |
| 2004/0129422 | A1 | 7/2004 | Themig | |
| 2004/0221986 | A1* | 11/2004 | Hosie et al. | 166/254.2 |
| 2005/0000691 | A1* | 1/2005 | Giroux et al. | 166/291 |
| 2005/0109508 | A1* | 5/2005 | Vella et al. | 166/297 |
| 2005/0173126 | A1 | 8/2005 | Starr et al. | |
| 2005/0178552 | A1 | 8/2005 | Fehr et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2006/0144590 | A1* | 7/2006 | Lopez de Cardenas et al. | 166/276 |

* cited by examiner

SYSTEM AND METHOD FOR WELL TREATMENT AND PERFORATING OPERATIONS

BACKGROUND

In many well related procedures, a casing is deployed within a wellbore and perforations are formed through the casing and into the surrounding formation. The perforations may be formed with a perforating gun that is lowered through the casing to a desired formation region. Once positioned at the desired location, the perforating gun is fired and perforations or openings are formed into the surrounding formation to enable flow of fluid between the surrounding formation and the interior of the casing.

A variety of well treatment procedures also may be performed in conjunction with the perforation operation. For example, a cementing operation can be performed to secure casing within the wellbore. The cementing operation may be used to secure an outer casing and/or another casing within the outer casing. In many applications, the cementing operation is initially performed, and the perforating operation is subsequently performed by moving the perforating gun downhole in a separate trip.

Other well treatment procedures also can be performed prior to or subsequent to the perforating operation. However, the well treatment procedures typically involve separate trips downhole in addition to the movement of the perforating gun downhole. The additional trips downhole require added time and expense during preparation of the well.

SUMMARY

In general, the present invention provides a system and method for performing efficient well treatment and perforation operations in a well. The system and method utilize a dart assembly that combines a dart and a perforating gun into a single unit. The dart separates a well treatment fluid, such as a cement slurry, from a displacement fluid used to move the dart and the treatment fluid downhole. The perforating gun is coupled to the dart and moves downhole with the dart. The combination enables a treatment operation, such as a cementing operation, and a perforating operation to be performed with a single trip downhole.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for treating a well and perforating a well with a single trip downhole. The system and methodology enable movement of a perforating gun into a desired position or location within the wellbore as a well treatment procedure is performed. For example, a cementing operation can be performed while the perforating gun is moved into the desired location. When the well treatment operation is completed, e.g. when the cement slurry has been properly deployed and cured, the perforating gun can be fired to form perforations into the surrounding formation.

Figure 1:
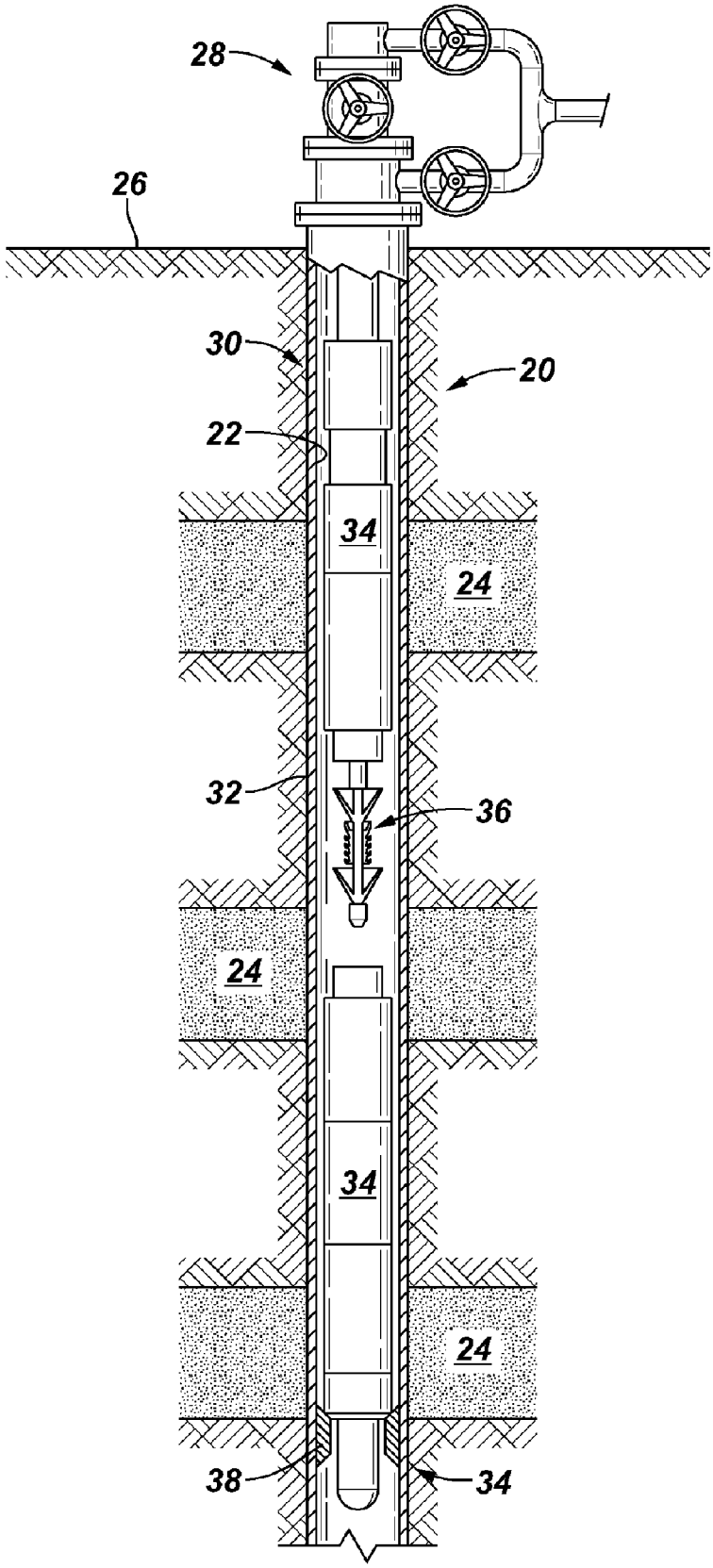
FIG. 1 is an elevation view of a wellbore with a well treatment system therein, according to an embodiment of the present invention.

Referring generally to FIG. 1, a well 20 comprises a wellbore 22 that extends downwardly through one or more subterranean formations 24. The formations 24 often hold desired production fluids, such as hydrocarbon based fluids. In the example illustrated, wellbore 22 extends downwardly from a surface 26 of the earth in a generally vertical orientation. A wellhead 28 is positioned at surface 26 above wellbore 22.

A well treatment system 30 is deployed in wellbore 22 and a may have a variety of configurations depending on the specific well treatment operation to be performed. By way of example, well treatment system 30 may comprise a casing 32 and a plurality of well treatment system components 34. Examples of well treatment system components 34 include controllable valves that may be operated to control the flow of treatment fluid. Components 34 also may comprise landing elements, sensors, communication equipment, and other flow control equipment. The well treatment system 30 incorporates specific components 34 designed to accommodate the desired operations required for the specific well application. For example, if the well treatment operation is a cementing operation, components 34 are selected to facilitate the cementing operation within wellbore 22.

In FIG. 1, the well treatment system 30 is illustrated as partially broken away to show a dart assembly 36 positioned for movement through casing 32 to a desired location. The dart assembly 36 is designed to enable both a well treatment operation, e.g. a cementing operation, and a well perforating operation. For example, dart assembly 36 may be used to separate a cement slurry, below dart assembly 36, from a displacement fluid used to move dart assembly 36 downhole. As the dart assembly 36 is moved downhole, cement slurry or other well treatment fluid is displaced into a specific well region until dart assembly 36 reaches a desired location for performance of a perforating operation. Dart assembly 36 may be landed at the desired location via a landing member 38, such as a casing shoe.

Figure 2:
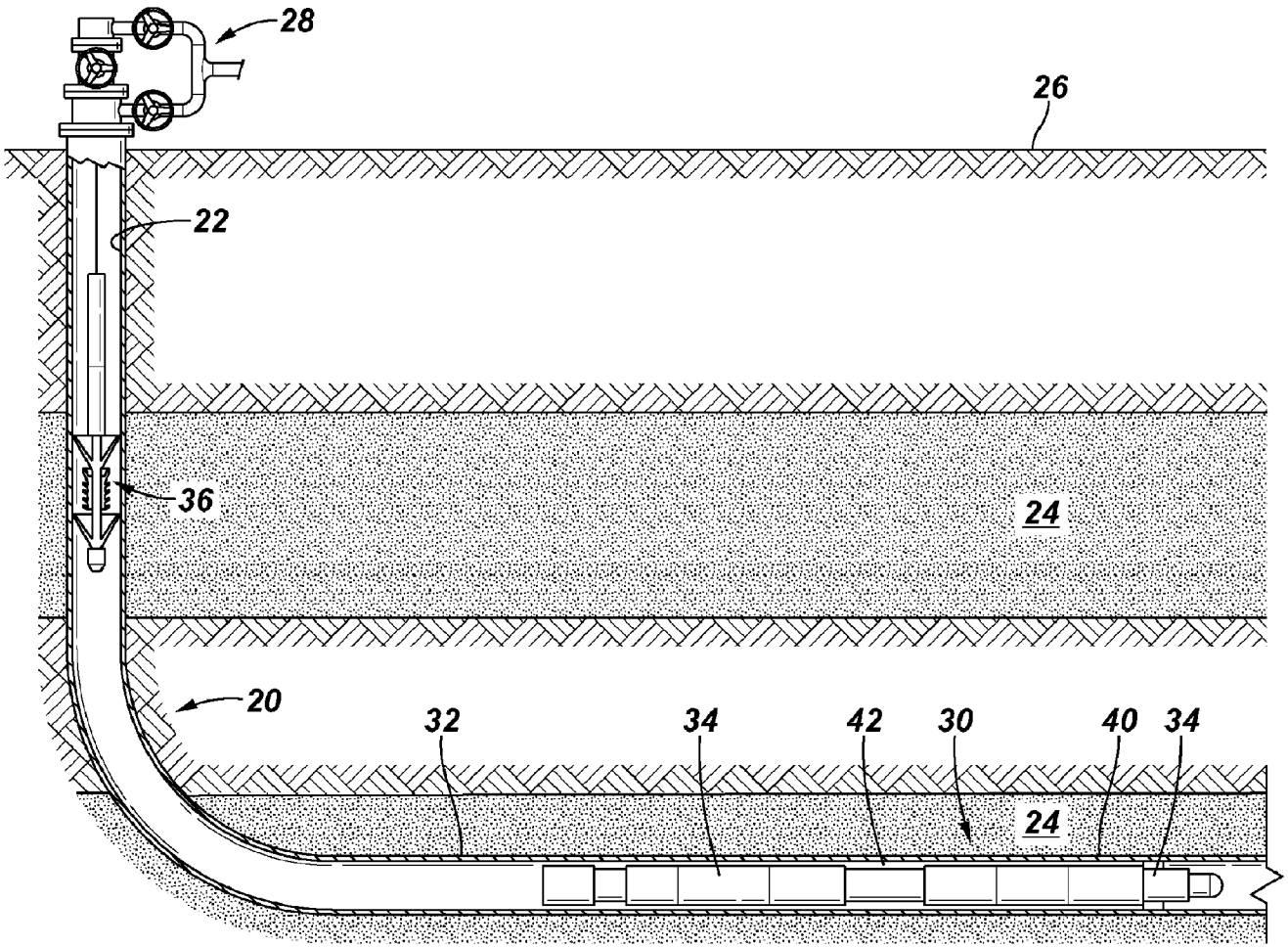
FIG. 2 is an elevation view of a deviated wellbore with a well treatment system therein, according to an embodiment of the present invention.

Another embodiment is illustrated in FIG. 2. In this embodiment, wellbore 22 includes a deviated section 40, e.g. a substantially horizontal section, in which a well treatment operation is performed. For example, an annulus region 42 of deviated section 40 may be filled with a cement slurry surrounding well treatment system 30 during a cementing operation. As described above with respect to the vertical wellbore embodiment, dart assembly 36 is used to separate a well treatment fluid, e.g. a cement slurry, from a displacement fluid and to move the well treatment fluid downhole into deviated section 40. During or upon completion of the well treatment, the dart assembly 36 can be used to create perforations into the surrounding formation without requiring an additional trip downhole.

Figure 3:
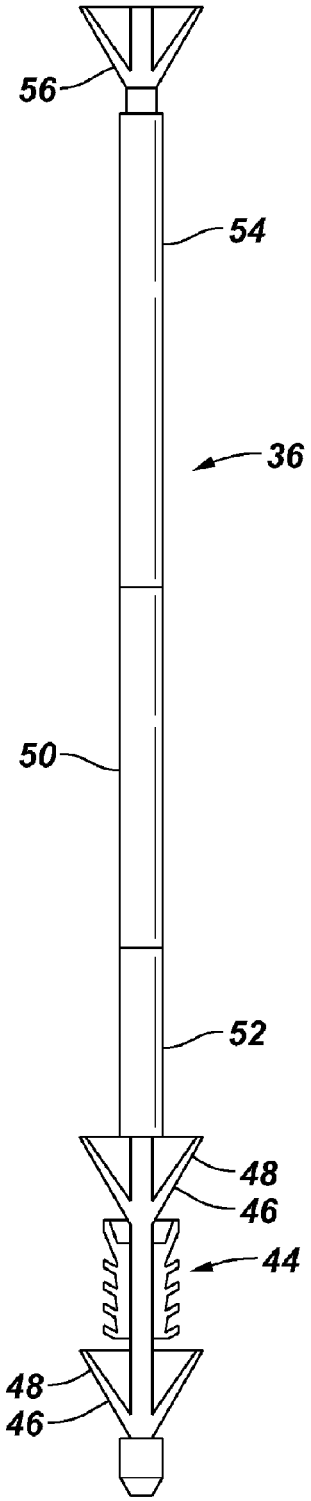
FIG. 3 is a front elevation view of a dart assembly, according to an embodiment of the present invention.

Referring generally to FIG. 3, one embodiment of dart assembly 36 is illustrated. In this embodiment, a dart 44 is positioned at a lead end of dart assembly 36. Dart 44 comprises one or more cup members 46 that each have an outwardly flared portion 48. Outwardly flared portions 48 function to effectively catch the displacement fluid used to drive the dart assembly 36 through casing 32. The outwardly flared portions 48 also function as scrapers to scrape well treatment fluid, e.g. cement slurry, from the inside wall surface of the casing through which dart assembly 36 is moved to its downhole location.

A perforating gun 50 is coupled to dart 44 for movement downhole with dart 44. Depending on the desired region to be perforated, perforating gun 50 may be spaced a predetermined distance from dart 44 by one or more spacers 52. The spacers 52 are selected such that perforations can be formed at a specific longitudinal distance from dart 44 once dart 44 has landed at a downhole location. Spacers 52 can be formed from metal, tubular members or other appropriate spacing structures that are positioned between perforating gun 50 and dart 44 when perforating gun 50 is coupled to dart 44.

Dart assembly 36 also may comprise a firing head 54 operatively coupled to perforating gun 50. The firing head 54 is used to actuate, i.e. fire, perforating gun 50 at a desired time, thereby creating perforations into the surrounding formation. The firing head 54, perforating gun 50, spacer(s) 52 and dart 44 are connected together in a single unit that is moved downhole through casing 32 in a single trip. In the embodiment illustrated, dart assembly 36 further comprises one or more rear cup members 56 positioned generally at an opposite longitudinal end of the assembly relative to cup members 46. The one or more rear cup members 56 further facilitate movement of dart assembly 36 downhole and the scraping of the surrounding tubular surface. Cup members 56 also assist in maintaining perforating gun 50 and firing head 54 in a generally radially centralized position within casing 32.

Figure 4:
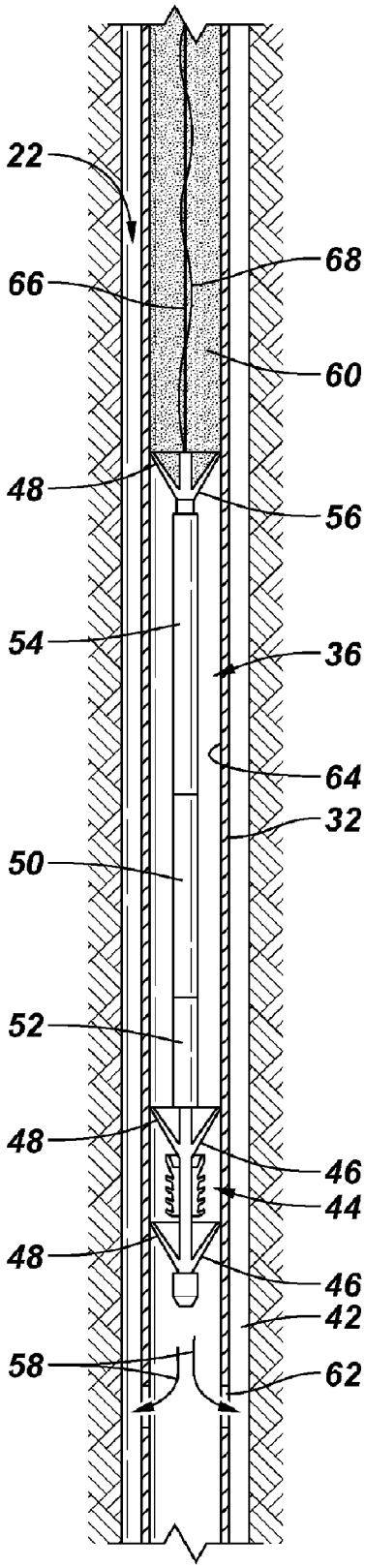
FIG. 4 is an elevation view of the dart assembly of FIG. 3 operatively deployed within a casing, according to an embodiment of the present invention.

When dart assembly 36 is deployed within casing 32, dart 44 is positioned between a treatment fluid, represented by arrows 58, and a displacement fluid 60, as illustrated in FIG. 4. The displacement fluid 60 is introduced into casing 32 to the rear of dart assembly 36. Movement of dart assembly 36 downhole through casing 32 directs treatment fluid 58 to the desired wellbore region 42. In a cementing operation, for example, the cement slurry may be moved into the annulus surrounding casing 32 via ports 62. The opening of ports 62, which may be earlier perforations, can be controlled by valves, e.g. sliding slave valves, or other mechanisms, as known to those of ordinary skill in the art. While the cement slurry or other treating fluid is delivered down through casing 32 and out through ports 62 into wellbore annulus region 42, cup members 46 and 56 act as scrapers to remove the cement slurry from an inside surface 64 of casing 32.

The dart assembly 36 also may be coupled to a deployment/retrieval mechanism 66 that can be used in the deployment and retrieval of dart assembly 36. Mechanism 66 comprises, for example, a cable, a wireline, a coiled tubing or another suitable deployment/retrieval mechanism that enables the removal of dart assembly 36 following the well treatment and perforation operations. Mechanism 66 can be used to accurately measure and control depth of the perforating gun. For example, mechanism 66 may comprise a deployment mechanism formed with a wire or other suitable mechanism that is used as a measurement tool to measure the distance the dart assembly moves downhole. This measurement capability can be particularly helpful when moving the perforating gun 50 into a horizontal wellbore. Mechanism 66 also may comprise one or more communication lines 68 used for the transmission of communication signals to or from dart assembly 36. For example, communication lines 68 can be used to provide trigger signals to firing head 54 to initiate the perforation operation. However, the communication line 68 also can be used to provide signals to additional downhole components that are combined with dart assembly 36 or that form part of the overall well treatment system 30. Furthermore, communication lines 68 can be used to transmit signals uphole from sensors or other components within dart assembly 36 and/or well treatment system 30.

Figure 5:
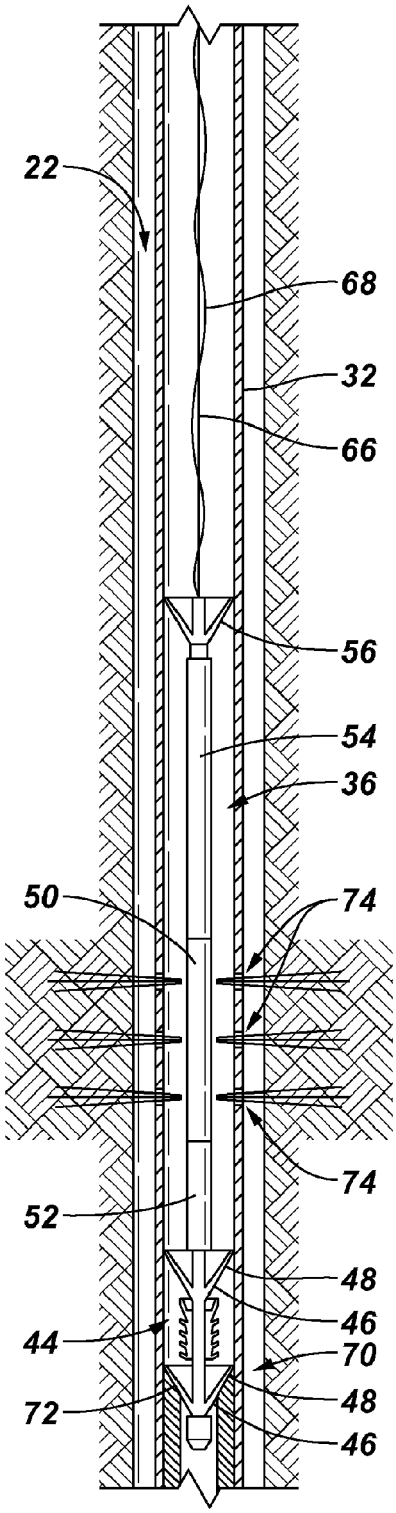
FIG. 5 is an elevation view similar to that of FIG. 4 but showing the dart assembly landed at a desired location for perforation of the well, according to an embodiment of the present invention.

In addition to the well treatment operation, dart assembly 36 can be used to perform a perforation operation without an additional trip downhole, as illustrated in FIG. 5. For example, once the treatment fluid 58 has been deliver downhole, dart 44 can be positioned, i.e. landed, at a specific, desired location 70 within wellbore 22. In the embodiment illustrated, dart 44 has been positioned in a landing member 72, such as a landing shoe. By using the one or more spacers 52, if necessary, perforating gun 50 can be positioned at precisely the desired location at which perforations are to be formed. Accordingly, at the appropriate point of time, e.g. upon curing of the cement slurry, perforating gun 50 is fired and a plurality of perforations 74 are formed.

Figure 6:
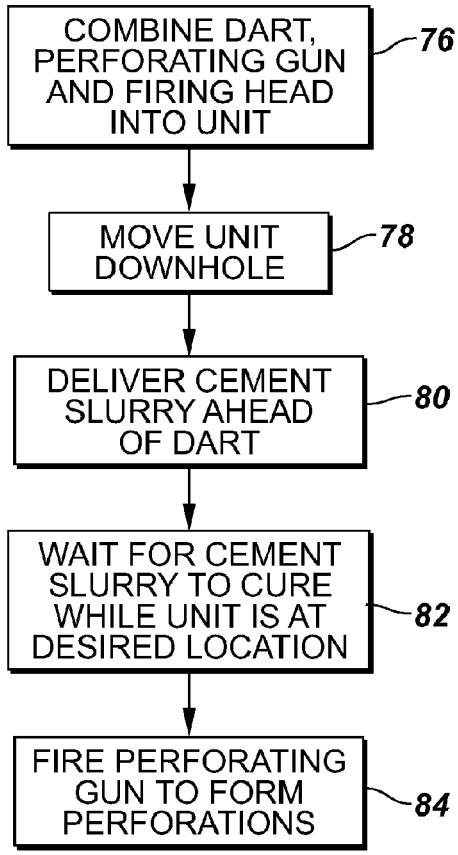
FIG. 6 is a flow chart representing one example of a method for performing a well treatment operation and a perforating operation, according to an embodiment of the present invention.

One example of the operation or methodology involved in providing a combined well treatment operation and perforation operation with a single trip downhole can be described with reference to the flowchart of FIG. 6. Initially, dart 44, perforating gun 50, and firing head 54 are provided as a single assembly or unit 36, as illustrated by block 76. The combined unit is moved downhole through casing 32 with an appropriate well treatment fluid disposed ahead of dart 44, as illustrated by block 78. The entire unit is moved until the treatment fluid is delivered to the desired location within the wellbore and/or the surrounding formation. In a cementing operation, for example, the treatment fluid comprises a cement slurry delivered ahead of dart 44 to a desired annulus region surrounding the casing for cementing of the casing, as illustrated by block 80. After delivering the cement slurry, the slurry is given time to cure while the assembly 36 is positioned at a desired, downhole location, as illustrated by block 82. For example, the unit/assembly 36 can be moved until all of the well treatment fluid, e.g. cement slurry, is delivered and the dart 44 is landed at landing location 70. At the appropriate time, e.g. upon curing of the cement slurry, perforating gun 50 is fired and perforations 74 are formed, as illustrated by block 84.

In general, by combining dart 44 and perforating gun 50 into a single assembly for simultaneous movement of the dart and perforating gun downhole, the efficiency of well preparation is increased while the costs are reduced. It should be noted that dart assembly 36 can be used in a variety of well treatment processes other than cementing operations. Additionally, well treatment fluids can be delivered ahead of dart 44 or to the rear of dart 44 in various combined well treatment and perforating operations. In other applications, assembly 36 may comprise additional darts 44 to deliver treatment fluids in stages. The overall well treatment system 30 also may comprise a variety of completions, configurations and components depending on the specific combined operations to be performed and the environment in which the operations are performed.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A perforating system, comprising:

a cement dart sized for movement downhole through a casing;

a perforating gun coupled to the cement dart for movement with the cement dart as a single assembly, the cement dart leading the perforating gun to enable displacement of cement; and a firing head coupled to the perforating gun.

2. The perforating system as recited in claim 1, further comprising a spacer between the perforating gun and the cement dart to locate the perforating gun at a specific location once the cement dart is landed downhole.

3. The perforating system as recited in claim 1, wherein the cement dart comprises a scraper to scrape cement from an inside surface of the casing as the cement dart is moved downhole.

4. A method of perforating, comprising:

connecting a perforating gun with a firing head to a dart sized for movement downhole through a casing such that the dart leads the perforating gun during the movement downhole to enable displacement of cement; and delivering the dart and the perforating gun to a desired location in a wellbore.

5. The method as recited in claim 4, further comprising moving a treatment fluid into the wellbore ahead of the dart as the dart is moved downhole.

6. The method as recited in claim 4, further comprising moving a cement sluffy into the wellbore ahead of the dart as the dart is moved downhole.

7. The method as recited in claim 4, further comprising coupling a firing head to the perforating gun prior to delivering the dart and the perforating gun to the desired location.

8. The method as recited in claim 7, further comprising spacing the perforating gun from the dart with a spacer.

9. The method as recited in claim 4, further comprising utilizing the dart to scrape an inside surface of the casing as the dart and the perforating gun are delivered to the desired location.

10. The method as recited in claim 4, further comprising firing the perforating gun and creating perforations at the desired location.

11. The method as recited in claim 4, further comprising measuring the distance the perforating gun and the dart travel downhole with a deployment mechanism.

12. The method as recited in claim 4, further comprising measuring the distance the perforating gun and the dart travel downhole.

13. A method of perforating, comprising:

moving in combination a cement dart, a perforating gun and a firing head downhole as a unit;

delivering a cement sluffy downhole with the cement dart;

waiting for the cement sluffy to cure downhole; and firing the perforating gun to create perforations at a desired location.

14. The method as recited in claim 13, further comprising inserting at least one spacer between the cement dart and the perforating gun.

15. The method as recited in claim 13, further comprising scraping an inside surface of a tubing with the cement dart as the unit is moved downhole.

16. The method as recited in claim 13, further comprising landing the cement dart in a casing shoe.

17. A system, comprising:

a well treatment system having a tubing through which a treatment fluid is moved; and a dart assembly movable through the tubing to a desired location, the dart assembly comprising a dart coupled to a perforating gun to form a combined assembly with the dart leading the perforating gun to move the treatment fluid ahead of the perforating gun.

18. The system as recited in claim 17, wherein the dart assembly further comprises a firing head coupled to the perforating gun to fire the perforating gun.

19. The system as recited in claim 17, wherein the dart is a cement dart.

20. The system as recited in claim 17, wherein the dart comprises a scraper to scrape an inside surface of the tubing as the dart moves through the tubing.

21. The system as recited in claim 17, wherein the dart assembly comprises a spacer having a desired length to space the perforating gun from the dart.

22. The system as recited in claim 17, wherein the well treatment system comprises a landing member to land the dart at a desired location.

23. The system as recited in claim 17, wherein the well treatment system comprises a cementing completion.

* * * * *